US005281108A

United States Patent [19]

Brooke

[11] Patent Number: 5,281,108

[45] Date of Patent: Jan. 25, 1994

[54] DIAPHRAGM PUMPS

[76] Inventor: Gerard Brooke, The Bannut Tree, New Inn Lane, Avening, Gloucestershire GL8 9NB, England

[21] Appl. No.: 784,407

[22] PCT Filed: Jun. 22, 1990

[86] PCT No.: PCT/GB90/00960

§ 371 Date: Dec. 23, 1991

§ 102(e) Date: Dec. 23, 1991

[87] PCT Pub. No.: WO91/00417

PCT Pub. Date: Jan. 10, 1991

[30] Foreign Application Priority Data

Jun. 23, 1989 [GB] United Kingdom ..... 8914516

[51] Int. Cl.[5] ..... F04B 43/06

[52] U.S. Cl. ..... 417/395; 91/50

[58] Field of Search ..... 417/395; 91/50

[56] References Cited

U.S. PATENT DOCUMENTS

| | | | |
|---|---|---|---|
| 1,920,146 | 7/1933 | Hueber | 91/50 |
| 3,168,045 | 2/1965 | Sebastiani | 417/395 |
| 3,429,274 | 2/1969 | Nilsson | 417/395 |
| 3,707,982 | 1/1973 | Hogel | 137/119 |
| 3,814,548 | 6/1974 | Rupp | 417/395 |
| 3,955,901 | 5/1976 | Hamilton | 417/395 |
| 4,319,570 | 3/1982 | Grane | 604/317 |
| 4,662,829 | 5/1987 | Nehring | 604/153 |

FOREIGN PATENT DOCUMENTS

| | | |
|---|---|---|
| 2292184 | 6/1976 | France . |
| 1049787 | 9/1962 | United Kingdom . |

*Primary Examiner*—Richard A. Bertsch
*Assistant Examiner*—Peter Korytnyk
*Attorney, Agent, or Firm*—Jones, Tullar & Cooper

[57] ABSTRACT

A diaphragm pump comprising a pumping chamber (10) is operated by a continuous flow of pressure gas to a driving chamber (12) separated from the pumping chamber by a flexible diaphragm (8 or 52). Deflection of the diaphragm by the gas pressure drives liquid out of the pumping chamber. The driving chamber has a normally closed outlet valve (30 or 54) connected to the diaphragm through a flexible or lost-motion connection (34, 36 or 56) so that the valve is opened after a certain deflection of the diaphragm. The driving chamber pressure is thereby released and allows the diaphragm to return, drawing further liquid into the pumping chamber. The return movement of the diaphragm also allows the valve to reclose and the cycle is repeated while the supply of pressure gas to the driving chamber is maintained.

14 Claims, 2 Drawing Sheets

DIAPHRAGM PUMPS

BACKGROUND OF THE INVENTION

This invention relates to diaphragm pumps operated by gas pressure, particularly but not necessarily exclusively for medical services.

U.S. Pat. No. 4,319,570 discloses a fluid-pressure operated diaphragm pump to be used as an aspirator or tracheal suction pump. It has a pumping chamber in part defined by a flexible diaphragm, the flexure of which creates a suction in a drainage line. In a further chamber separated from the pumping chamber by a secondary sealing diaphragm is a valve mechanism comprising inlet and outlet valve members which are opened and closed in opposition to each other as the diaphragm reciprocates, the opening of the outlet valve being triggered by the flexure of the diaphragm to a position of maximum pumping chamber volume and the opening of the inlet valve being triggered by a return spring that is operative when the diaphragm flexes to a position of minimum pumping chamber volume. The valve mechanisms required in this pump are relatively complex. They therefore carry an increased risk of malfunction in addition to being relatively expensive to produce. Cost is particularly important if the valve is to be disposable, as is often required for surgical apparatus.

Another pressure-fluid operated diaphragm pump is disclosed in U.S. Pat. No. 4,662,829 in which pumping and driving chambers are separated by a flexible diaphragm and the driving chamber is connected continuously to a pressure air source. The flexible diaphragm is stretched over an exhaust port of the driving chamber during the contraction of the pumping chamber, by virtue of the pressure differential between the pumping chamber and the exhaust line, until the continuing flexure of the diaphragm under the driving fluid pressure forces the port open. At that stage, the pressure in the driving chamber is released via the exhaust port, the diaphragm collapses onto that port, and the cycle begins again.

Although this pump has a relatively simple mechanism as compared with the previously described example, it has inherent disadvantages. In particular, in order for the diaphragm to maintain a seal with the driving chamber exhaust, a portion of its area must be held stationary during the pumping stroke despite the fact that the deflection of the diaphragm that is lost thereby reduces the pumping rate. It is possible to compensate for this to a limited extent by employing more flexible diaphragm materials but the risk of overstressing and rupture of the diaphragm is then increased, and such measures cannot make up for the limitation of the pumping rate for any given size of pump due to the fact that part of the diaphragm is not participating in the pumping stroke.

SUMMARY OF THE INVENTION

According to the present invention, there is provided a fluid-pressure operated pump comprising a pumping chamber having inlet and outlet openings for a fluid to be pumped and a fluid pressure driving chamber, a flexible diaphragm between the pumping and driving chambers being displaceable by the driving fluid pressure to pump fluid through the pumping chamber, said driving chamber having an inlet for a pressure fluid supply for reciprocating the diaphragm and an outlet valve biased to a closed position, means connecting the outlet valve to the diaphragm and permitting limited deflection of the diaphragm by the pressure of the fluid in the driving chamber without displacement of the valve from said closed position, diaphragm displacement by the pressure fluid beyond said limited deflection acting through said connecting means to open the outlet valve and reduce the driving chamber pressure thereby reversing the direction of displacement of the diaphragm to permit the valve to return to the closed position and allow the pressure in the driving chamber to increase again.

In one form of the invention, the outlet valve comprises or is secured to a member that is flexibly deformable to release pressure from the driving chamber. In another form of the invention, a flexibly deformable member is arranged to release pressure from the driving chamber when in an undeformed state and, by its deformation, to allow the limited displacement of the diaphragm while the outlet remains closed.

BRIEF DESCRIPTION OF THE DRAWINGS

Examples of the invention will be described in more detail, by way of illustration of the invention, with reference to the accompanying schematic drawings, in which.

DESCRIPTION OF PREFERRED EMBODIMENTS

Figure 1:
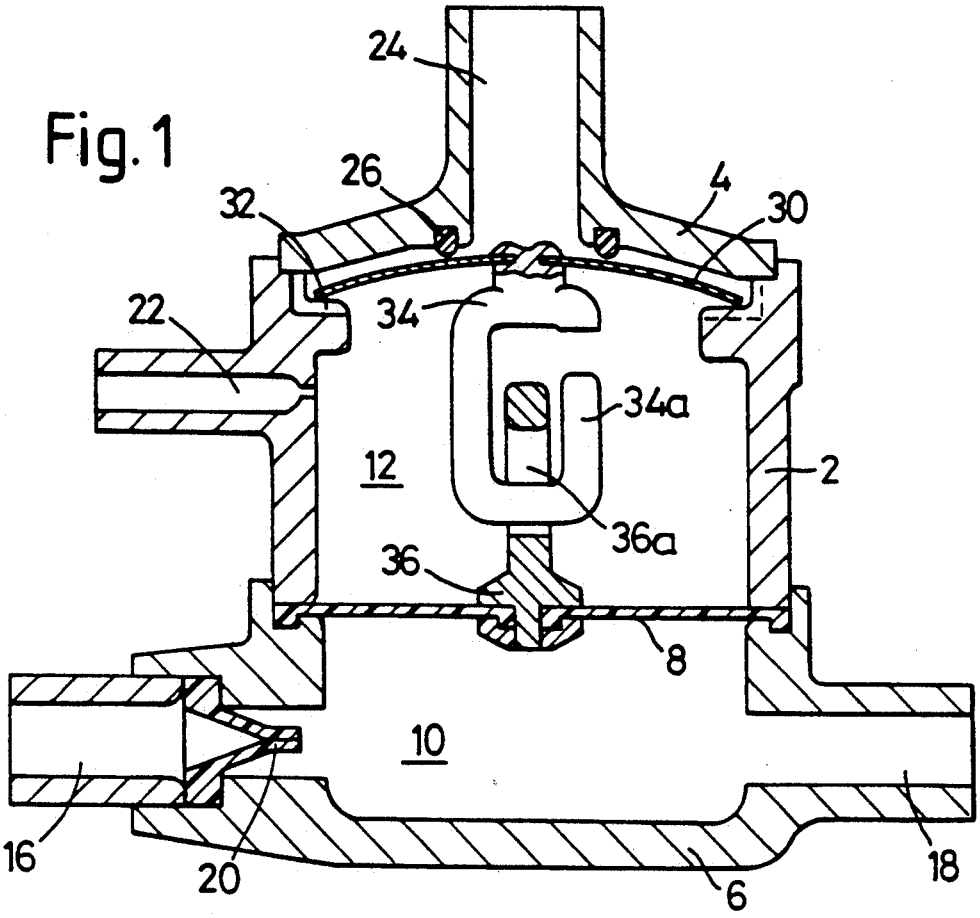
FIG. 1 is an axial cross-section of one form of pump according to the invention.

Referring to FIG. 1 of the drawings, the pump has a three-part casing comprising a central generally cylindrical part 2 and top and bottom covers 4, 6. Between the central casing part and the bottom cover, a flexible diaphragm 8 is clamped at its periphery. The diaphragm forms a fluid-tight boundary dividing the casing interior into a lower liquid pumping chamber 10 and an upper pressure-gas driving chamber.

The casing bottom cover 6 has an inlet 16 and an outlet 18 for the pumping chamber 10. The inlet 16 is provided with a non-return valve 20 in the form of a flexible moulding with sealing lips that open only to allow a flow into the chamber.

The main casing part 2 has a restricted inlet 22 opening into the driving chamber 12 for connection to a source of pressure gas, eg. air. The top cover 4 has a central outlet port 24 from the driving chamber, and an outlet valve seat 26 surrounds that port.

On an inner peripheral shoulder in the central casing part 2, there rests a valve disc 30, shown in its sealing position in which it bears against the valve seat 26. The disc 30 is a bistable plate that can be snapped over from the upwardly convex form illustrated to a downwardly convex form in which it is spaced from the valve seat. Independently of the position of the disc, there is free communication between the casing spaces above and below it through reliefs 32 in the shoulder.

Connecting the diaphragm 8 and the valve disc 80 is a lost motion mechanism comprising upper and lower links 34,36 anchored to the centres of the disc 30 and the diaphragm 8 respectively. The two links have interconnecting ends in the form of a hook 34*a* and a ring 36*a* which effectively operate as a pin and slot connection.

Each link is thus able to move axially to a limited extent relative to the other, as determined by the internal height of the ring 36a and the vertical thickness of the arm of the hook 34a passing through the ring.

In use, pressure air is supplied continuously to the inlet 22. The diaphragm 8 is deflected downwards from the position shown by the pressure in the driving chamber to expel liquid from the pumping chamber outlet 18. As the diaphragm deflects, its link 36 descends until the top section of the ring 36a engages the hook 34a. The valve disc 30 is then pulled down until it snaps over to its downwardly convex state, opening the driving chamber 12 to the outlet port 24. With the outlet 24 open, the restricted inlet 22 is unable to maintain pressure in the driving chamber 12, so that the diaphragm rebounds to its undeflected state, increasing the volume of the pumping chamber 10 to draw more liquid in through the non-return valve 20. As the link 36 rises with the diaphragm 8 to strike the top section of the hook 34a the valve disc 30 is snapped back to the upwardly convex position in which it is shown. The driving chamber outlet 24 is once more sealed off and the cycle begins again.

The action of the pump can be stopped simply by the use of a shut-off valve (not shown) in the pumped liquid outlet line from the outlet 18. While pressure continues to be applied to the driving chamber inlet 22, the pump restarts automatically when that outlet valve is opened.

Figure 2:
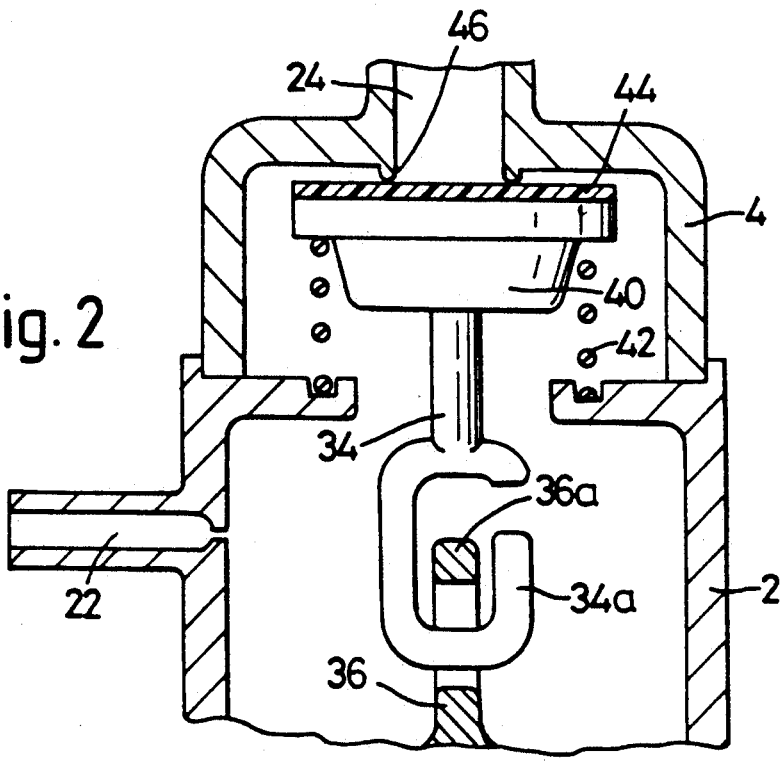
FIG. 2 shows a modification of the pump in FIG. 1.

In FIG. 2, the reference numbers of FIG. 1 are used for the same parts. The pump is, however, modified by replacing the bistable valve disc 30 with a rigid valve body 40 biased by a spring 42 to the closing position. The valve body 40 is fixed to the hooked link 34 and it has a resilient sealing layer 44 that bears against a valve seat 46 formed integrally in the top cover 4 around the outlet port 24. The modified pump operates in an identical manner to the pump of FIG. 1 except that the driving chamber valve body 40 is continuously biased to its upward position by the spring 42 which can thus accelerate the return movement of the diaphragm between pumping strokes.

Figure 3:
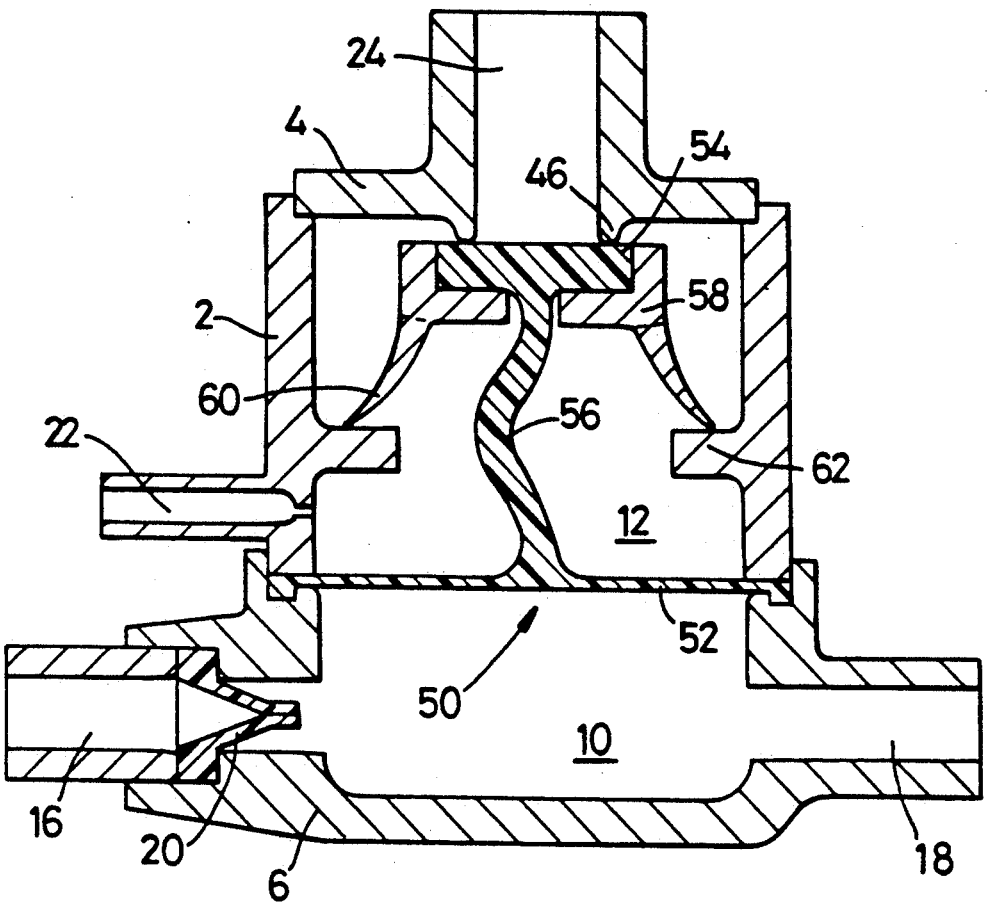
FIG. 3 shows another form of pump according to the invention in axial cross-section.

In FIG. 3, parts similar to those already described are again indicated by the same reference numbers. In this embodiment the pump has a one-piece moulding 50 providing diaphragm 52, valve plate 54 and an interconnecting flexible stem 56. The stem may be straight in its relaxed state but is able to act as a collapsible strut when placed in compression. A resilient spider 58 has a central recess housing the valve plate 54. Radial legs 60 on the spider bear flexibly on a peripheral shoulder 62 inside the driving chamber 12 to urge the valve plate 54 against the seat 46 surrounding the driving chamber outlet 24.

In operation, during the pumping stroke the downward flexure of the diaphragm 52 by the pressure applied in the driving chamber first allows the stem 56 to straighten and then pulls the valve plate 54 off the seat 46 to release the pressure in the driving chamber. As in the previous examples, the pressure drop in the driving chamber allows the diaphragm 52 to rise upwards, so that first the driving chamber outlet 24 is reclosed and then the compression load on the stem 56 causes it to buckles elastically. The mechanism thus returns to its illustrated state and the cycle is repeated while pressure gas continues to be supplied to the driving chamber and the outlet from the pumping chamber remains open.

It is of course possible to substitute elements from one of the illustrated embodiments in another of those embodiments. It will be understood, furthermore, that many other modifications and alternatives are possible within the scope of the invention.

I claim:

1. A fluid-pressure operated pump comprising a pumping chamber having inlet and outlet openings for a fluid to be pumped and a fluid pressure driving chamber, a flexible diaphragm between the pumping and driving chambers being displaceable by the fluid pressure in said driving chamber to pump fluid through the pumping chamber, said driving chamber having an inlet for a supply of pressure fluid thereto and an outlet valve comprising a valve member biased to close said valve, means connecting the outlet valve member to the diaphragm and permitting a limiting deflection of the diaphragm by the pressure of the fluid in the driving chamber without displacement of the valve member from said closed position, diaphragm displacement by the pressure fluid beyond said limited deflection acting through said connecting means to displace said valve member to open the outlet valve and reduce the driving chamber pressure, thereby reversing the direction of displacement of the diaphragm to permit the valve member to return to the valve-closing position and allow the pressure in the driving chamber to increase again, said means connecting the outlet valve member to the diaphragm comprising a connector member that is flexibly deformable for permitting relative displacement between the valve member and the diaphragm without opening the outlet valve, said connection member comprising a unitary, one-piece unit with at least one of said diaphragm and said outlet valve.

2. A pump according to claim 1 wherein said outlet valve member, flexibly deformable member and diaphragm are unitary, to form said unitary, one-piece unit.

3. A pump according to claim 1 wherein said flexibly deformable member is a unitary elongate member extending substantially centrally through the driving chamber.

4. A pump according to claim 1 wherein said flexibly deformable member is unitary, and is resiliently biased to restrain opening of the valve when the valve is in the closed position.

5. A pump according to claim 1 wherein the connection member is arranged to act as a collapsible strut to permit said limited deflection of the diaphragm relative to the outlet valve.

6. A fluid-pressure operated pump comprising a pumping chamber having inlet and outlet openings for a fluid to be pumped and a fluid pressure driving chamber, a flexible diaphragm between the pumping and driving chambers being displaceable by the fluid pressure in said driving chamber to pump fluid through the pumping chamber, said driving chamber having an inlet for a supply of pressure fluid thereto and an outlet valve comprising a valve member biased to close said valve, a unitary, one-piece molding connecting the outlet valve member to the diaphragm and permitting a limited deflection of the diaphragm by the pressure of the fluid in the driving chamber without displacement of the valve member from said closed position, diaphragm displacement by the pressure fluid beyond said limited deflection acting through said one-piece molding to displace said valve member to open the outlet valve and reduce the driving chamber pressure, thereby reversing the direction of displacement of the diaphragm to permit the valve member to return to the valve-closing position and allow the pressure in the driving chamber to increase again, a unitary one-piece molding including at least one of said outlet valve member and said diaphragm and providing said means connecting the outlet valve member to the diaphragm, the molding being flexibly deformable for permitting relative displacement between the valve member and the diaphragm without opening the outlet valve.

7. A pump according to claim 6 wherein said molding comprises an elongate member extending substantially centrally through the driving chamber between said valve member and said diaphragm, said member, said valve member, and said diaphragm forming a one-piece unit.

8. A pump according to claim 6 wherein said molding is resiliently biased to restrain opening of the valve when the valve is in the closed position.

9. A fluid-pressure operated pump comprising a pumping chamber having inlet and outlet openings for a fluid to be pumped and a fluid pressure driving chamber, a flexible diaphragm between the pumping and driving chambers being displaceable by the fluid pressure in said driving chamber to pump fluid through the pumping chamber, said driving chamber having an inlet for a supply of pressure fluid thereto and an outlet valve comprising a valve member biased to close said valve, means connecting the outlet valve member to the diaphragm and permitting a limiting deflection of the diaphragm by the pressure of the fluid in the driving chamber without displacement of the valve member from said closed position, diaphragm displacement by the pressure fluid beyond said limited deflection acting through said connecting means to displace said valve member to open the outlet valve and reduce the driving chamber pressure, thereby reversing the direction of displacement of the diaphragm to permit the valve member to return to the valve-closing position and allow the pressure in the driving chamber to increase again, said means connecting the outlet valve member to the diaphragm comprising a strut-form connection member that is flexibly collapsible for permitting relative displacement between the valve member and the diaphragm without opening the outlet valve.

10. A pump according to claim 9 wherein the flexibly deformable member and the diaphragm are formed as an integral unit.

11. A pump according to claim 9 wherein outlet valve member and flexible deformable member are formed as an integral unit.

12. A pump according to claim 9 wherein said outlet valve member, flexibly deformable member and diaphragm are formed as an integral unit.

13. A pump according to claim 9 wherein said flexibly deformable member is an elongated member extending substantially centrally through the driving chamber.

14. A pump according to claim 9 wherein said flexibly deformable member is resiliently biased to restrain opening of the valve when the valve is in the closed position.

* * * * *